US008723617B2

(12) United States Patent
Caspers

(10) Patent No.: US 8,723,617 B2
(45) Date of Patent: May 13, 2014

(54) REDUCTION OF MULTIPACTING BY MEANS OF SPATIALLY VARYING MAGNETIZATION

(75) Inventor: Fritz Caspers, St. Genis Pouilly (FR)

(73) Assignee: CERN—European Organization for Nuclear Research, Geneva (CH)

( * ) Notice: Subject to any disclaimer, the term of this patent is extended or adjusted under 35 U.S.C. 154(b) by 389 days.

(21) Appl. No.: 13/124,450

(22) PCT Filed: Oct. 22, 2008

(86) PCT No.: PCT/EP2008/008934
§ 371 (c)(1),
(2), (4) Date: May 12, 2011

(87) PCT Pub. No.: WO2010/045955
PCT Pub. Date: Apr. 29, 2010

(65) Prior Publication Data
US 2011/0205002 A1 Aug. 25, 2011

(51) Int. Cl.
*H01J 25/76* (2006.01)

(52) U.S. Cl.
CPC ..... *H01J 25/76* (2013.01)
USPC ..... 333/99 MP; 29/602.1; 333/13

(58) Field of Classification Search
CPC ..... H01J 25/76
USPC ..... 333/13, 99 MP; 29/602.1
See application file for complete search history.

(56) References Cited

U.S. PATENT DOCUMENTS

| | | | | |
|---|---|---|---|---|
| 3,967,155 | A * | 6/1976 | Chavanat et al. | 315/39.55 |
| 4,035,688 | A * | 7/1977 | Mourier | 315/39 |
| 5,177,403 | A | 1/1993 | Kawaguchi et al. | 315/39.71 |
| 2009/0284126 | A1 * | 11/2009 | Protz et al. | 313/495 |

FOREIGN PATENT DOCUMENTS

| | | | | |
|---|---|---|---|---|
| JP | 1-281700 | | 11/1989 | H05H 13/04 |
| JP | 03-145035 | A | 6/1991 | H01J 23/54 |
| JP | 2006-246314 | A | 9/2006 | H01P 1/161 |

OTHER PUBLICATIONS

Ang, L. K., et al., "Susceptibility Diagram of Multipactor Discharge on a Dielectric—Effects of an External Magnetic Field and Oblique RF Electric Field," *Plasma Science*, 1999. ICOP '99. IEEE Conference Record—Abstracts. 1999 IEEE International Conference on Monterey, CA, Jun. 20-24, 1999. 1P06, p. 105.

Patrik Flierl, Authorized Officer European Patent Office, International Searching Authority, International Search Report and Written Opinion dated Jul. 17, 2009, PCT/EP2008/008934 filed Oct. 22, 2008, 14 pages.

* cited by examiner

*Primary Examiner* — Benny Lee
*Assistant Examiner* — Rakesh Patel
(74) *Attorney, Agent, or Firm* — Sunstein Kann Murphy & Timbers LLP

(57) ABSTRACT

The present invention discloses an apparatus comprising an enclosure (10) suitable for forming a vacuum therein and means for at least partially suppressing the multipacting effect when a RF or microwave electromagnetic field is generated in said vacuum. In the apparatus, the means for at least partially suppressing the multipacting effect comprises means (12) for passively generating a locally varying magnetic field (16) in the vicinity of at least a portion of the inner surface of said enclosure.

30 Claims, 1 Drawing Sheet

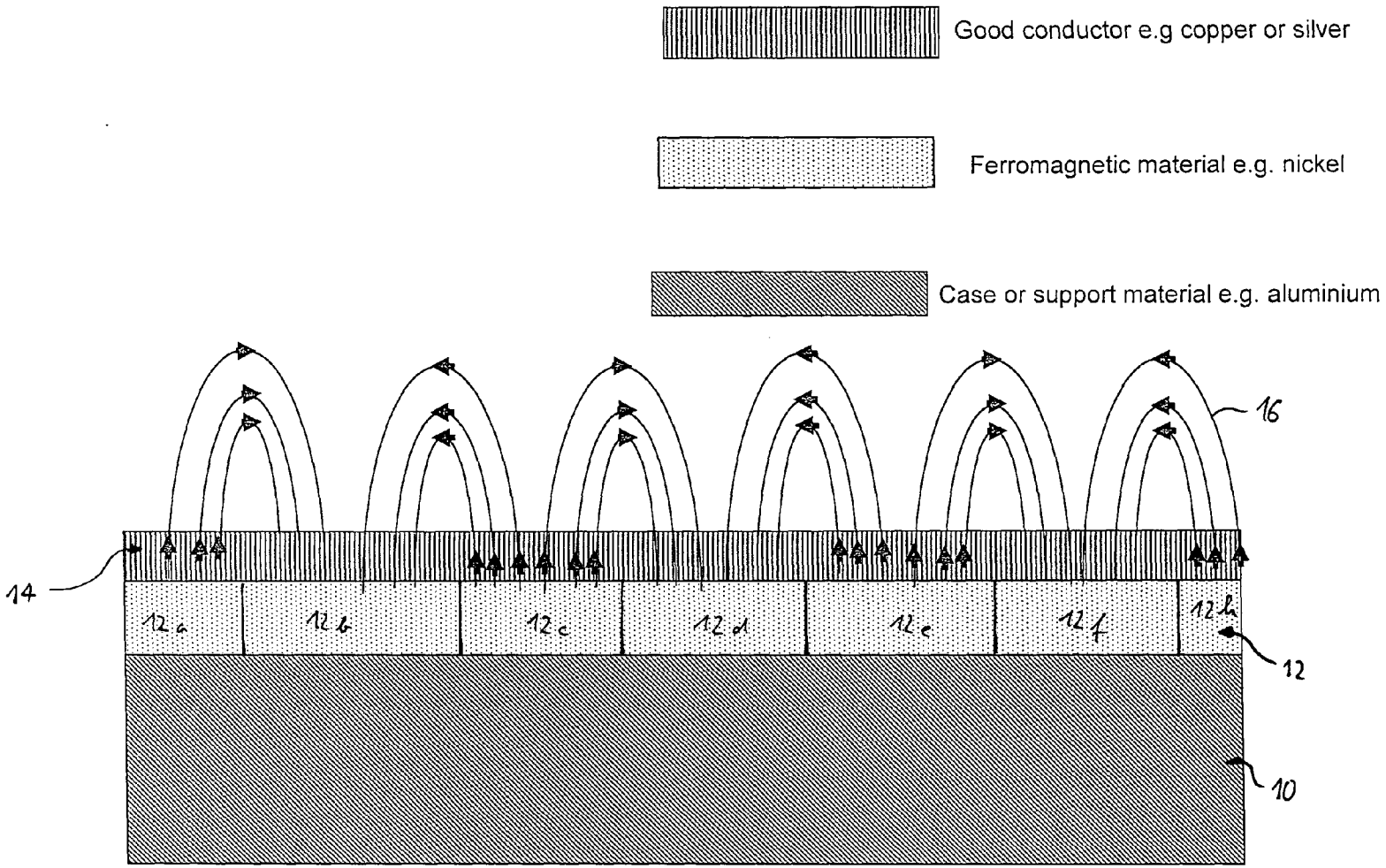
Good conductor e.g copper or silver
Ferromagnetic material e.g. nickel
Case or support material e.g. aluminium
16
12
10
12.h
12.f
12.e
12.d
12.c
12.b
12.a
14

REDUCTION OF MULTIPACTING BY MEANS OF SPATIALLY VARYING MAGNETIZATION

FIELD OF THE INVENTION

The present invention relates to an apparatus comprising an enclosure suitable for forming a vacuum therein and means for at least partially suppressing a multipacting effect when an RF—or microwave electromagnetic field is generated in said vacuum. The invention further relates to a method of forming such apparatus and a method of at least partially suppressing multipacting effects in a vacuum enclosure.

BACKGROUND

Multipacting, also called multipactoring, is a phenomenon of resonant electron multiplication in a vacuum to which an RF or microwave (MW) field is applied. Multipacting occurs when electrons in the RF or MW field oscillate synchronously and lead to a secondary emission of electrons when hitting electrodes or other surfaces of the enclosure. If the secondary electron yield (SEY), i. e. the average number of electrons emitted by a surface when hit by an electron is larger than one, the number of electrons constantly increases and builds up an electron avalanche, which in turn leads to remarkable power losses and heating of the enclosure walls. Accordingly, due to multipacting it becomes difficult to increase the cavity fields by raising the incident power. In superconductive structures, a large rise of temperature due to multipacting can lead to a thermal breakdown. Also, a heavy bombardment of multipacting electrons may even break ceramic windows in the power feed lines. Due to these problems, there is a strong desire to suppress multipacting in vacuum RF or MW devices.

In principle, multipacting can occur in any device or apparatus where considerable microwave or RF power is used in a vacuum enclosure or cavity. Specifically, multipacting is known to be a serious problem in microwave devices of satellites, such as microwave filters and wave guides. With regard to satellites or other space applications, the power losses and power limitation due to multipacting are extremely disadvantageous as for obvious reasons, power supply is severely limited in space. However multipacting also adversely affects the operation of particle accelerators, such as linear particle accelerators used in medical radiotherapy devices, or accelerators used in physics or material sciences.

In prior art, different approaches are known to suppress the undesirable multipacting effect. Since multipacting is essentially an electron resonance effect, in one approach one seeks to design the field enclosure or cavity such as to avoid resonance of the high frequency electric field to be used. For example, if the electron runtime between two opposite electrodes happens to be an odd multiple of half a period of the field, the electrons will acquire a net acceleration between the electrodes and can thus build up an electron avalanche. Accordingly, one approach to suppress multipacting is to avoid combinations of driving field and cavity geometries that would lead to such resonances. However, this greatly limits the variety of possible device geometries and applicable electromagnetic fields and is thus an undesirable limitation for the design of a device.

A second approach for suppressing multipacting is a rather microscopic one: as mentioned before, the multipacting effect occurs when the secondary electron yield (SEY) is larger than one. Accordingly, if one is able to decrease the SEY, multipacting can be effectively suppressed or massively reduced. There have been attempts to decrease the SEY by using special surface coatings, such as titanium nitrate and others. However, such coating techniques have the problem that they tend to increase the RF or microwave losses. Also, in some cases the coatings are not stable in time, particularly when they are temporarily exposed to air.

A further microscopic approach for lowering the SEY is based on an artificial microscopic roughening of the inner surface of the enclosure. The surface roughness acts as a kind of local electron trap as it reduces the probability that secondary electrons released from the surface can actually escape. Due to the rough surface structure, released secondary electrons may be immediately caught again by a protruding portion of the surface such that it does not contribute to the buildup of an electron avalanche. While artificial surface roughening has in fact proven to allow a reduction of SEY, unfortunately, it also considerably increases microwave and RF losses, which in particular with regard to applications in satellites or space technology in general is disadvantageous.

Accordingly, there still exists a need for an apparatus having means for at least partially suppressing multipacting, a method for making such apparatus and a method for suppressing multipacting.

SUMMARY OF THE INVENTION

The present invention overcomes the above mentioned disadvantages of the prior art by an apparatus, a method of forming such apparatus and a method of at least partially suppressing the multipacting effect. Preferable embodiments are defined in the dependent claims.

According to the invention, the means for at least partially suppressing the multipacting effect comprise means for passively generating a locally varying magnetic field in the vicinity of at least a portion of the inner surface of the enclosure. If the length scale of the variations of the magnetic field is chosen appropriately small, or in other words, the spatial frequency of magnetic field variations is sufficiently high, the locally varying magnetic field will cause secondary electrons released from the surface of the enclosure to be forced along a bent curve and to reenter the surface just after leaving it. Simply put, at least a portion of such secondary electrons are "trapped" by the locally varying magnetic field and thus do not contribute to the SEY. Accordingly, due to the locally varying magnetic field, the SEY can be dramatically decreased, such that multipacting can be reliably suppressed.

Note that the locally varying magnetic field can be thought of as a "magnetic roughness", while at the same time the inner surface of the enclosure may be structurally smooth, such that the problem of power losses encountered when using structurally rough surfaces is avoided. Accordingly, the present invention allows to suppress multipacting without having to pay for it by significant power loss of the RF or MW fields.

In one preferred embodiment, the means for at least partially suppressing the multipacting effect comprises a layer of ferromagnetic material which is statically magnetized such as to generate a locally varying magnetic field. This is one example of "passively" generating a locally varying magnetic field, since the ferromagnetic material only has to be locally magnetized once, for example using an ordinary writing head known for writing on magnetic strips on credit cards or the like, but the magnetization is then maintained.

In principle, any ferromagnetic material can be used as long as it has a sufficient remanence and a sufficiently high Curie temperature such that the static magnetization is preserved during operation.

An advantageous example of a ferromagnetic material is nickel. For example, in microwave cavities or filters currently used in satellites, the cavity is often formed by an aluminum wall covered by a nickel layer and an additional conductive layer, such as a silver layer, forming the inner surface of the cavity. In such applications, the nickel layer has the effect that it provides for a good adhesion between the carrier (for example an aluminum housing) and the conductive coating (for example the silver layer). In other words, in many applications a suitable intermediate nickel layer is present anyhow, albeit for a completely different purpose. In a preferable embodiment, this intermediate nickel layer can be statically magnetized with a locally varying magnetization such that multipacting can be suppressed with only minimal modification of existing devices.

In order to provide for an effective suppressing of SEY, it is preferable that the magnetic field varies locally on a length scale that is less than 300 μm, preferably less than 70 μm and most preferably less than 40 μm in at least one in plane dimension, i.e. in a dimension parallel to the surface of the enclosure. If the locally varying magnetic field is formed by a layer of ferromagnetic material that is statically magnetized, this means that the layer could be at least partially comprised of regions having magnetizations different from at least one adjacent region, where the average size of said regions in at least one in-plane dimension is less than 300 μm, preferably less than 70 μm, and most preferably less than 40 μm. The magnetic pattern could be even more rapidly varying in space on an order of 10 to 30 μm, similar to the magnetization pattern that is conventionally generated for a magnetic tape or strip.

Preferably, the ferromagnetic layer is formed on top of an aluminum layer and is covered by a conductive layer, for example silver. In a preferred embodiment, the thickness of the ferromagnetic layer and/or the conductive layer formed on top of it is 5 to 30 μm, and more preferably 7-15 μm. The ferromagnetic layer may also consist from several layers of ferromagnetic material.

In a preferred embodiment, the apparatus is a component of a satellite, such as a waveguide or a microwave filter. But it may also be a normal conducting cavity or normal conducting RF coupler on a normal conducting or super conducting cavity.

In an alternative embodiment, the apparatus comprises means for applying a macroscopic magnetic field and an non-uniform distribution of a ferro-magnetic material arranged in the vicinity of the inside surface of said enclosure such as to locally modulate the macroscopic magnetic field. For example, the macroscopic field could be a quasi homogenous magnetic field generated for example by a bending magnet used in an accelerator structure. The term "quasi homogenous" indicates that this macroscopic field is homogenous at least on the length scale of the non-uniform distribution of the magnetic material. Then, the microscopic magnetic field is locally modulated by the ferromagnetic material according to its non-uniform distribution, which again allows to obtain a locally or spatially varying magnetic field. In this case, the ferromagnetic material is preferably a soft magnetic material having a low remanence, such that the magnetization will disappear, if the macroscopic magnetic field is switched off.

The microstructure of the ferromagnetic material is again preferably on a sub-millimeter length scale and could be less than 100 μm or even less than 40 μm. If the distribution of ferromagnetic material varies only microscopically, the macroscopic magnetic field is not affected or only affected by a homogenous component that can be easily compensated for. In other words, the effect of the locally varying magnetic field in the vicinity of the enclosure surface is not noticeable or at least compensatable some distance away from the surface, such that the function of the apparatus is not affected thereby. Quantitatively, the non-uniform distribution of the ferromagnetic material is preferably chosen such that the amplitude of the modulation of the magnetic field strength drops to less than 15%, preferably less than 1% in a central portion of the enclosure.

In a preferred embodiment, the non-uniform distribution of ferromagnetic material can be formed by a patterned layer of ferromagnetic material such as a mesh, a reticulated, or a cell-like structure. Such a structure can not only be manufactured easily, but it allows for the formation of a rapidly varying microscopic material distribution while providing for a uniform macroscopic distribution, such that the net effect of the ferromagnetic material is that of a uniform additional field if one moves sufficiently away from the vicinity of the enclosure surface, which can then be compensated for easily. Accordingly, the electromagnetic field inside the enclosure is not disturbed for all practical purposes.

Again, the cells forming the structure can be at least in one in-plane dimension on an order of less than 1 mm, preferably less than 100 μm and most preferably less than 40 μm.

Such an embodiment with a non-uniform distribution of ferromagnetic material for modulating the microscopic magnetic field is especially suitable for use in particle accelerators, as used in medical technology, such as radiotherapy apparatuses, or in physics or materials science applications.

BRIEF DESCRIPTION OF THE DRAWING

FIG. 1 is a schematic section of view of a layer structure suitable for at least partially suppressing the multipacting effect.

DESCRIPTION OF THE PREFERRED EMBODIMENT

For the purposes of promoting an understanding of the principles of the invention, reference will now be made to the preferred embodiment illustrated in the drawing and a specific language will be used to describe the same. It will nevertheless be understood that no limitation of the scope of the invention is thereby intended, such alterations and further modifications in the illustrated device and/or method and such further applications of the principles of the invention as illustrated therein being contemplated as would normally occur now or in the future to one skilled in the art to which the invention relates.

In FIG. 1, a schematic cross section view of a layer structure that can be used in one embodiment of the invention is shown. As seen in FIG. 1, the layer comprises a bottom layer 10 which could be a case or a support material of an enclosure suitable for forming a vacuum therein. For example, the layer 10 could be a part of a microwave guide, an accelerator cavity or a microwave filter structure. On top of the bottom layer 10, an intermediate layer 12 made of a ferromagnetic material, in the present example nickel, is formed. On top of the ferromagnetic intermediate layer 12, a conducting layer 14 made for example of copper or silver is formed.

Both, the conducting layer 14 and the ferromagnetic layer 12 have a thickness on the order of 10 μm. The layer structure shown in FIG. 1 is per se known for example from microwave filter devices, where an intermediate nickel layer is disposed in between an aluminum carrier layer and a silver conducting layer, to provide for a good adhesion of the layers.

However, according to the invention the ferromagnetic layer 12 is locally magnetized such as to generate magnetized regions 12*a* to 12*h*, where adjacent regions have a different magnetization, as is indicated by magnetic field lines 16 in FIG. 1.

The magnetized regions 12*a* to 12*h* may be 10 to 30 μm wide, which leads to a spatially rapidly varying magnetic pattern. Such a magnetic pattern can be easily obtained using ordinary magnetic writing technology used for writing on magnetic tapes or magnetic strips used for credit cards or the like.

When the structure shown in FIG. 1 is used in a wall of a vacuum enclosure, where the conducting layer 14 forms the inside surface of the enclosure, the multipacting effects upon applying an RF or microwave field can be at least partially suppressed. Namely, if an electron impinges the conducting layer 14 and releases a secondary electron, due to the magnetic field 16 this electron may not easily escape but is forced on a curved path and is likely to reenter the conductive surface 14. This way, the secondary electron yield (SEY) is effectively lowered. In fact, due to the locally varying magnetic field 16, in practice the SEY can be lowered to such an extent that no electron avalanche builds up, i. e. that multipacting is completely suppressed.

The thickness of the conducting layer 14 is chosen to preferably correspond to five or more skin depths at the frequency of operation. This means that the ferromagnetic layer 12 is shielded from the RF or MW field by the conductive layer 14. Also, the upper surface of the conductive layer 14 is perfectly smooth, such that the power losses encountered when using artificially roughened surfaces is avoided. Thus, the invention allows to avoid multipacting without significant power loss, which makes this invention especially attractive in cases where power supply is limited, such as in satellites or other space applications.

The spatially or locally varying magnetic field 16 is generated by passive means, namely by a static magnetization of ferromagnetic layer 12 with a rapidly varying magnetization pattern. However, instead of locally magnetizing ferromagnetic layers such as layer 12 on FIG. 1, in an alternative embodiment it would also be possible to provide a locally varying distribution of ferromagnetic material, which is exposed to a macroscopic or external magnetic field. Namely, if a macroscopic magnetic field is applied, for example by a bending magnet in an accelerator structure, the ferromagnetic material will locally enhance the magnetic field and thus lead to a locally varying magnetic field as well. In a preferred embodiment (not shown) the distribution of ferromagnetic material is inhomogenous on a microscopic length scale but homogenous on a macroscopic length scale, such as to allow for a spatially rapidly varying magnetic field close to the surface of the conducting layer, which becomes more and more uniform as one moves away from the surface. This way, the net field caused by the distribution of ferromagnetic material in a center portion of the enclosure will be either vanishing or the at least a homogenous magnetic field, which could easily be compensated for by for example adjusting the current in the external magnet coil.

A suitable distribution of ferromagnetic material could, for example, be obtained by using a grid or meshlike ferromagnetic layer, where the distribution of ferromagnetic material varies rapidly on a microscopic scale (namely between mesh and hole) but where the overall macroscopic distribution of the material is still homogenous.

This alternative embodiment using an inhomogenous microscopic distribution of ferromagnetic material is also a way of "passively" generating a locally varying magnetic field. This second embodiment is especially suitable for use in particle accelerator structures using bending magnets for deflecting particle paths.

As can be seen from the above description, in both embodiments the SEY and thus the multipacting can be efficiently suppressed with only minimal additional structural effort. In particular, the first embodiment that was shown in FIG. 1 is extremely simple and cost-effective and compatible with all the stringent requirements for satellite payloads without showing drawbacks like increased RF power losses or long-term stability problems of existing solutions.

Although two preferred exemplary embodiments are shown and specified in detail, in the preceding of specification, these should be viewed as purely exemplary and not as limiting the invention. It is noted in this regard that only the preferred exemplary embodiments are shown and specified, and all variations and modifications should be protected that presently or in the future lie within this scope of protection of the invention.

The invention claimed is:

1. An apparatus comprising:

an enclosure suitable for forming a vacuum interior to an inner surface of the enclosure; and means for at least partially suppressing a multipacting effect when a RF or microwave electromagnetic field is generated in said vacuum by decreasing a yield of secondary electrons, characterized in that said means for at least partially suppressing the multipacting effect comprises means for generating a locally varying magnetic field in the vicinity of at least a portion of the inner surface of said enclosure adapted for trapping at least a portion of the secondary electrons so as not to contribute to the yield of secondary electrons, wherein said means for at least partially suppressing the multipacting effect comprises a layer of ferromagnetic material which is statically magnetized such as to generate the locally varying magnetic field.

2. The apparatus of claim 1, wherein said layer of ferromagnetic material is at least partially comprised of regions having magnetizations different from at least one adjacent region, where the average size of said regions in at least one in-plane dimension is less than 300 μm.

3. The apparatus of claim 1, wherein said layer of ferromagnetic material is at least partially comprised of regions having magnetizations different from at least one adjacent region, where the average size of said regions in at least one in-plane dimension is less than 70 μm.

4. The apparatus of claim 1, wherein said layer of ferromagnetic material is at least partially comprised of regions having magnetizations different from at least one adjacent region, where the average size of said regions in at least one in-plane dimension is less than 40 μm.

5. The apparatus of claim 1, wherein the main constituent of said layer of ferromagnetic material is nickel.

6. The apparatus of claim 1, wherein said layer of ferromagnetic material is covered by a conducting layer forming at least a portion of the inner surface of said enclosure.

7. The apparatus of claim 6, wherein at least the main constituent of said conducting layer is silver.

8. The apparatus of claim 1, wherein the thickness of the layer of ferromagnetic material and a conducting layer formed on top of said layer of ferromagnetic material is 5 μm to 30 μm.

9. The apparatus of claim 8, wherein the thickness of the layer of ferromagnetic material and the conducting layer formed on top of said layer of ferromagnetic material is 7 μm to 15 μm.

10. The apparatus of claim 1, wherein said layer of ferromagnetic material is formed on top of an aluminum layer.

11. The apparatus of claim 1, wherein said apparatus is a component of a satellite.

12. The apparatus of claim 1, wherein said apparatus is a component of a waveguide or a microwave filter.

13. An apparatus comprising:

an enclosure suitable for forming a vacuum interior to an inner surface of the enclosure; and means for at least partially suppressing a multipacting effect when a RF or microwave electromagnetic field is generated in said vacuum by decreasing a yield of secondary electrons, characterized in that said means for at least partially suppressing the multipacting effect comprises means for generating a locally varying magnetic field in the vicinity of at least a portion of the inner surface of said enclosure adapted for trapping at least a portion of the secondary electrons so as not to contribute to the yield of secondary electrons, wherein the apparatus comprises means for applying a macroscopic magnetic field and also comprises a non-uniform distribution of ferromagnetic material arranged in the vicinity of the inside surface of said enclosure such as to locally modulate a microscopic magnetic field.

14. The apparatus of claim 13, wherein the non-uniform distribution is such that the amplitude of the modulation amplitude of the locally varying magnetic field strength drops to less than 15% in a central portion of the enclosure.

15. The apparatus of claim 13, wherein the non-uniform distribution is such that the amplitude of the modulation amplitude of the locally varying magnetic field strength drops to less than 1% in a central portion of the enclosure.

16. The apparatus of claim 13, wherein said non-uniform distribution is formed by a patterned layer of ferromagnetic material.

17. The apparatus of claim 16, wherein said patterned layer has a mesh, grid or cell-like structure characterized by a cell size in at least one in-plane dimension that is less than 1 mm.

18. The apparatus of claim 16, wherein said patterned layer has a mesh, grid or cell-like structure characterized by a cell size in at least one in-plane dimension that is less than 100 μm.

19. The apparatus of claim 16, wherein said patterned layer has a mesh, grid or cell-like structure characterized by a cell size in at least one in-plane dimension that is less than 40 μm.

20. The apparatus of claim 13, wherein said apparatus is a particle accelerator.

21. A method of forming an apparatus in which a multipacting effect is at least partially suppressed, comprising the steps of:

providing an enclosure that can be evacuated to a vacuum, and providing means for passively generating a locally varying magnetic field in the vicinity of at least a portion of the inner surface of said enclosure, wherein said step of providing means for passively generating a locally varying magnetic field comprises a step of providing a ferromagnetic layer in the vicinity of the inner surface of said enclosure and magnetizing the ferromagnetic layer according to a locally varying pattern.

22. The method of claim 21, wherein the locally varying pattern at least in one in-plane dimension varies on a length scale of less than 300 μm.

23. The method of claim 22, wherein the locally varying pattern at least in one in-plane dimension varies on a length scale of less than 70 μm.

24. The method of claim 23, wherein the locally varying pattern at least in one in-plane dimension varies on a length scale of less than 40 μm.

25. The method of claim 21, wherein the step of magnetizing the ferromagnetic layer is performed using a magnetic writing head.

26. A method of at least partially suppressing a multipacting effect in a vacuum enclosure in which an RF or microwave electromagnetic field is generated, characterized in that a yield of secondary electrons is decreased by trapping at least a portion of the secondary electrons in a locally varying magnetic field created by providing a layer of ferromagnetic material in the vicinity of at least a portion of the inner surface of said enclosure, wherein the layer of ferromagnetic material is statically magnetized such as to generate said locally varying magnetic field.

27. The method of claim 26, wherein said layer of ferromagnetic material is magnetized according to a locally varying pattern which at least in one in-plane dimension varies on a length scale less than 300 μm.

28. The method of claim 26, wherein said layer of ferromagnetic material is magnetized according to a locally varying pattern which at least in one in-plane dimension varies on a length scale less than 70 μm.

29. The method of claim 26, wherein said layer of ferromagnetic material is magnetized according to a locally varying pattern which at least in one in-plane dimension varies on a length scale less than 40 μm.

30. The method of claim 26, wherein said locally varying magnetic field is provided by a non-uniform distribution of said layer of ferromagnetic material arranged in the vicinity of the inside surface of said enclosure such as to locally modulate a macroscopic magnetic field.

* * * * *

UNITED STATES PATENT AND TRADEMARK OFFICE

CERTIFICATE OF CORRECTION

PATENT NO. : 8,723,617 B2
APPLICATION NO. : 13/124450
DATED : May 13, 2014
INVENTOR(S) : Fritz Caspers It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 409 days.

Signed and Sealed this
Twenty-ninth Day of September, 2015

Michelle K. Lee

Michelle K. Lee
*Director of the United States Patent and Trademark Office*